US005722903A

United States Patent [19]

Moriyama et al.

[11] Patent Number: 5,722,903

[45] Date of Patent: Mar. 3, 1998

[54] GOLF BALL

[75] Inventors: Keiji Moriyama, Shirakawa; Satoshi Iwami, Himeji, both of Japan

[73] Assignee: Sumitomo Rubber Industries, Ltd., Hyogo-Ken, Japan

[21] Appl. No.: 584,363

[22] Filed: Jan. 11, 1996

[30] Foreign Application Priority Data

Jan. 13, 1995 [JP] Japan ..... 7-004418

[51] Int. Cl.[6] ..... A63B 37/14

[52] U.S. Cl. ..... 473/384; 40/327

[58] Field of Search ..... 473/383, 384; 40/327

[56] References Cited

U.S. PATENT DOCUMENTS 4,284,276 8/1981 Worst ..... 473/383

4,869,512 9/1989 Nomura et al. ..... 473/383

5,356,150 10/1994 Lavallee et al. ..... 473/383

*Primary Examiner*—George J. Marlo

*Attorney, Agent, or Firm*—Birch, Stewart, Kolasch & Birch, LLP

[57] ABSTRACT

In a golf ball having a large number of dimples formed on the surface thereof, the dimples comprise circular dimples 2 and oval dimples 3 in flat configurations thereof. The total of the oval dimples is set to more than 20% of the total of the dimples. All the dimples are arranged in such a manner that an average intersection acute angle δ made between a line connecting the center of each oval dimple and a pole of the golf ball with each other and a major axis of each oval dimple is set in a range of $0 \leqq \delta \leqq 80°$.

8 Claims, 8 Drawing Sheets

GOLF BALL

BACKGROUND OF THE INVENTION

1. Field of the Invention

The present invention relates to a golf ball, and more particularly to a golf ball having dimples, the surface configuration of which are improved to make the flow of air in the periphery thereof turbulent when it is flying in the air, so as to allow the golf ball to have a superior aerodynamic symmetrical property and allow it to fly a long distance, although one great circle path unintersecting with a seam line is present on the golf ball.

2. Description of the Prior Art

Normally, 280–540 dimples are formed on the surface of the golf ball. The role of the dimple is to make the flow of air in the periphery thereof turbulent when the golf ball is flying in the air so as to accelerate the transition of turbulent flows present in a boundary layer. That is, the role of the dimple is to reduce pressure resistance by shifting a separation point rearward and improve dynamic lift by increasing the pressure difference between the portion above the separation point and the portion below the separation point. Therefore, the dimple capable of making the flow of the air in the periphery of the golf ball turbulent is aerodynamically superior.

Golf balls having dimples, formed on its surface, capable of effectively making the air in the periphery thereof turbulent have been proposed in view of the role of the dimple. For example, as disclosed in (1) Laid-Open Japanese Patent Publication No. 62-79072, a golf ball on which circular dimples of two different diameters are formed; and as disclosed in (2) Laid-Open Japanese Patent Publication No. 62192181, a golf ball on which dimples of a plurality of diameters are arranged densely.

If a plurality of great circle paths, unintersecting with dimples, is formed on the surface of the golf ball, there is an increase in the area of a land, namely, a region in which dimples are not formed. Thus, the turbulence of air cannot be increased sufficiently. In view of this, the present applicant proposed a golf ball which was disclosed in Laid-Open Japanese Patent Publication No. 04-150875. According to the disclosure, dimples arranged regularly in divisions of a spherical surface formed by geometrically projecting a regular polyhedron thereon are re-arranged by shifting them not to allow the presence of great circle paths, and dimples positioned on the seam line corresponding to the face of contact between a pair of molding dies are shifted upward or downward or eliminated so that only one great circle path is present on the surface of the golf ball on the seam.

The flow of air in the periphery of the golf ball becomes turbulent and the flight distance thereof is increased when dimples of different diameters are arranged densely in combination as disclosed in the above (1) and (2), further when only one great circle path unintersecting with dimples is present on the seam line, as disclosed in Laid-Open Japanese Patent Publication No. 04-150875.

But because the great circle path unintersecting with dimples is present on the seam line, the conventional golf balls are not sufficient in displaying a favorable aerodynamic symmetrical property. That is, the flight distance of the golf ball is varied according to a hitting position.

That is, referring to FIG. 1A, due to the presence of a great circle path (S) unintersecting with dimples, the flight distance of the golf ball in pole hitting is different from that in seam hitting. Seam hitting means a way of hitting the golf ball such that a line connecting both poles (P,P) with each other serves as a rotation axis L1 in back spin, as shown in FIG. 1(A), while pole hitting means a way of hitting the golf ball such that a line perpendicular to the rotation axis L1 serves as a rotation axis L2, as shown in FIG. 1(B).

A golf ball having a great difference in the flight distance thereof depending on a rotational axis is not approved as an official golf ball.

Needless to say, the golf ball is required to be approved as an official golf ball. In addition, the golf ball is demanded to have a difference smaller than the officially approved reference value in its flight distance and a favorable aerodynamic symmetrical property, regardless of rotation axes.

SUMMARY OF THE INVENTION

It is accordingly an object of the present invention to provide a golf ball having the same flight characteristic in both seam hitting and pole hitting, the direction of which is perpendicular to that of seam hitting; having a difference between the flight distance in seam hitting and in pole hitting in not more than the officially approved reference value; having the same trajectory in seam hitting and in pole hitting; having a superior aerodynamic symmetrical property in seam hitting and in pole hitting; and having an increased flight distance.

As a result of researches made by the inventors based on experiments, the inventors have found that dimples, of which the plan view are oval, have a great influence on the aerodynamic characteristic of a golf ball. Based on the experimental result, they have devised a golf ball by forming oval dimples on the surface thereof in combination with circular dimples and devised a method of arranging oval and circular dimples in combination to allow the flow of air in the periphery of the golf ball to be turbulent. Therefore, even though a great circle path unintersecting with dimples is present on the seam line, the golf ball can be allowed to have a much smaller difference in the flight distance in seam hitting and pole hitting and have a longer flight distance than conventional golf balls.

More specifically, as defined in claim 1, in a golf ball having a large number of dimples formed on the surface thereof, the dimples comprise circular dimples and uncircular, namely, oval dimples in plan view thereof; the total of the oval dimples is set to more than 20% of the total of the dimples; and the oval dimples are arranged in such a manner that an average intersection acute angle $\delta$ made between a line connecting the center of each oval dimple and a pole of the golf ball with each other and the major axis line of each oval dimple is set in a range of $0 \leqq \delta \leqq 80°$.

As shown in FIG. 2, the intersection acute angle $\delta$ means an angle made between the line (L) connecting the center (O) of each oval dimple 3 and a pole (P) of the golf ball with each other and the major axis (X) of each oval dimple, namely, the longest axis of axes passing through the center (O) of the oval dimple 3. The intersection acute angle $\delta$ is set in a range of $0 \leqq \delta \leqq 90°$. The average angle $\delta$ is obtained by dividing the total of the angles $\delta$ of all oval dimples by the total of the oval dimples.

As defined in claim 1, favorably, the average acute angle $\delta$ of the oval dimple is set in a range of $0 \leqq \delta \leqq 80°$ and more favorably, in a range of $0 \leqq \delta \leqq 40°$.

The oval dimple defined in claim 2 has the major axis (X) and the minor axis (Y) both passing through the center (O) thereof, and includes an elliptical dimple and an oval dimple defined a narrow sense. The oval dimple in a narrow sense are formed by connecting two circles arranged at a certain interval with each other with two common tangents. The ratio of the length of the major axis, of the oval dimple, passing through its center to the length of its minor axis passing through its center is set in a range of 1.2 to 3.5.

As defined in claim 3, the total of the oval dimples is set to more than 20% of the total of the dimples. The oval dimples consist of the ones in a narrow sense, the elliptical dimples or a combination of the oval dimples in a narrow sense and the elliptical dimples.

As defined in claim 4, the golf ball has only one great circle path, unintersecting with the dimples, formed on the surface thereof.

In the golf ball according to the present invention, the oval dimples allowing the air in the periphery of the golf ball to be greatly turbulent are formed on the surface thereof in combination with circular dimples in such a manner that the total of the oval dimples is set to more than 20% of the total of the dimples. Therefore, the dimples of the golf ball are capable of making the air in the periphery thereof more turbulent and flying it a longer distance than conventional golf balls.

Further, as the oval dimples are arranged in such a manner that the intersection acute angle $\delta$ is set in a range of $0 \leqq \delta \leqq 80°$, even though a great circle path unintersecting with dimples is present on the seam line, the dimples make the air in the periphery of the golf ball more turbulent than conventional dimples. Therefore, based on the inventors' experimental result, the flight distance and the trajectory between seam hitting and pole hitting, of the golf ball according to claim 2 have a smaller difference that the conventional golf ball.

Based on the inventors' experimental result, the configuration of the oval dimple is set in such a manner that the ratio of the length of its major axis to the length of its minor axis is set in a range of 1.2 to 3.5, as defined in claim 2. The oval dimple having such a configuration is capable of making the flow of the air in the periphery of the golf ball more turbulent than the conventional dimples. If the configuration of the oval dimple is set in such a manner that the ratio of the length of its major axis to the length of its minor axis is set in a range of less than 1.2, the oval dimple having such a configuration is incapable of allowing the golf ball to have a favorable aerodynamic characteristic. If the configuration of the oval dimple is set in such a manner that the ratio of the length of its major axis to the length of its minor axis is set in a range of more than 3.5, the oval dimple having such a configuration increases a difference between directionality in the major axis and that in the minor axis. As a result, the golf ball has a particular directionality. Thus, preferably, the ratio is set in the range of 1.2 to 3.5.

As defined in claim 3, the oval dimples set to more than 20% of the total of the dimples consist of the oval dimples in a narrow sense, the elliptical dimples or a combination of the oval dimples in a narrow sense and the elliptical dimples. The oval dimples allow the golf ball to fly a longer distance and the favorable aerodynamic symmetrical property thereof to be superior.

As defined in claim 4, it is preferable to reduce the number of great circle paths unintersecting with dimples to a possible smallest number, namely, to the one present on the seam line so as to arrange dimples densely, namely, reduce the area of a land on the surface of the golf ball. The dimples thus arranged on the surface of the golf ball allows the flow of air in the periphery thereof to be more turbulent and the golf ball to be flied a longer distance than the conventional golf ball.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

A golf ball according to the present invention is described below with reference to drawings.

Figure 6:
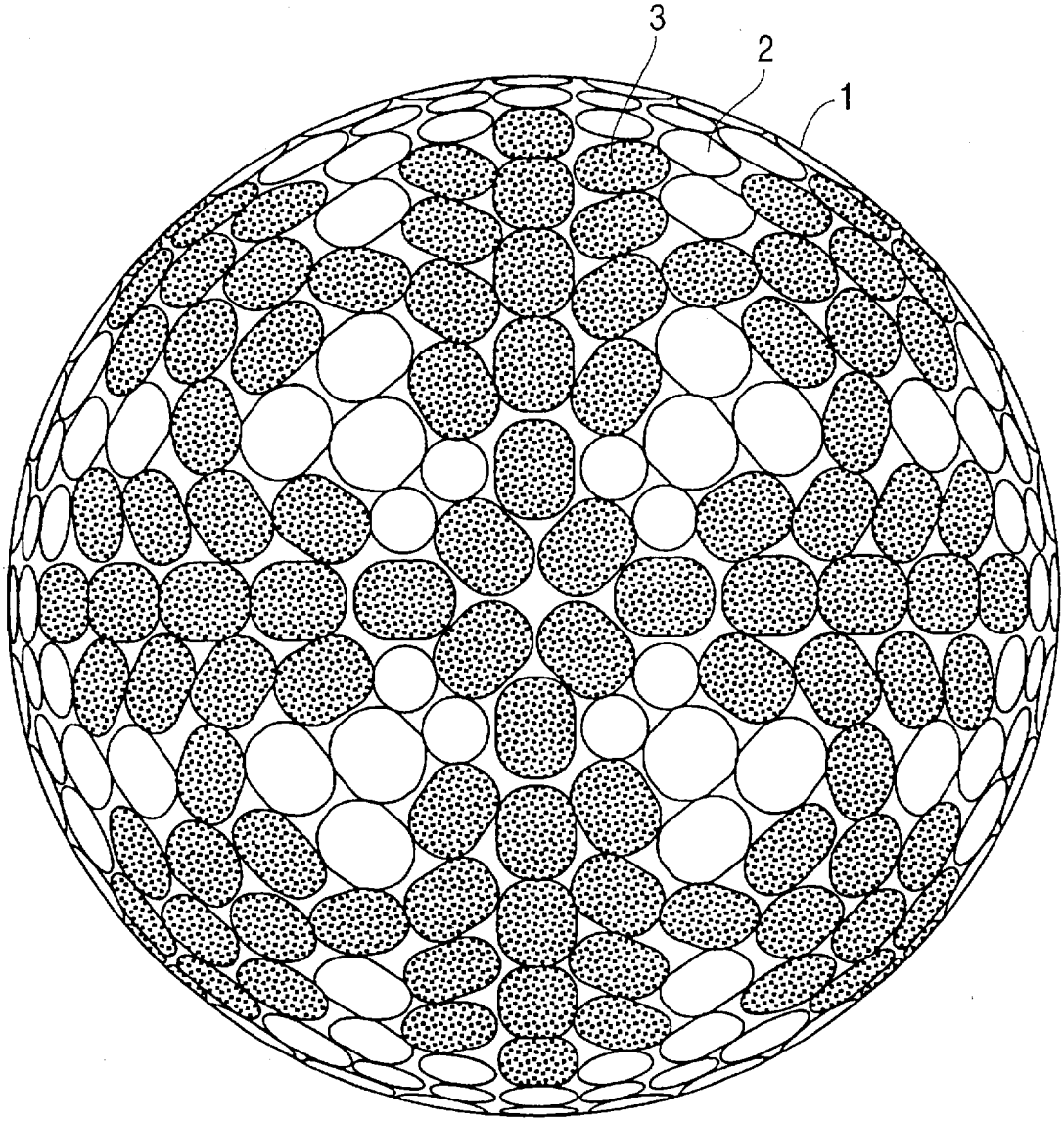
FIG. 6 is a front view showing a golf ball according to a first embodiment.
Figure 7:
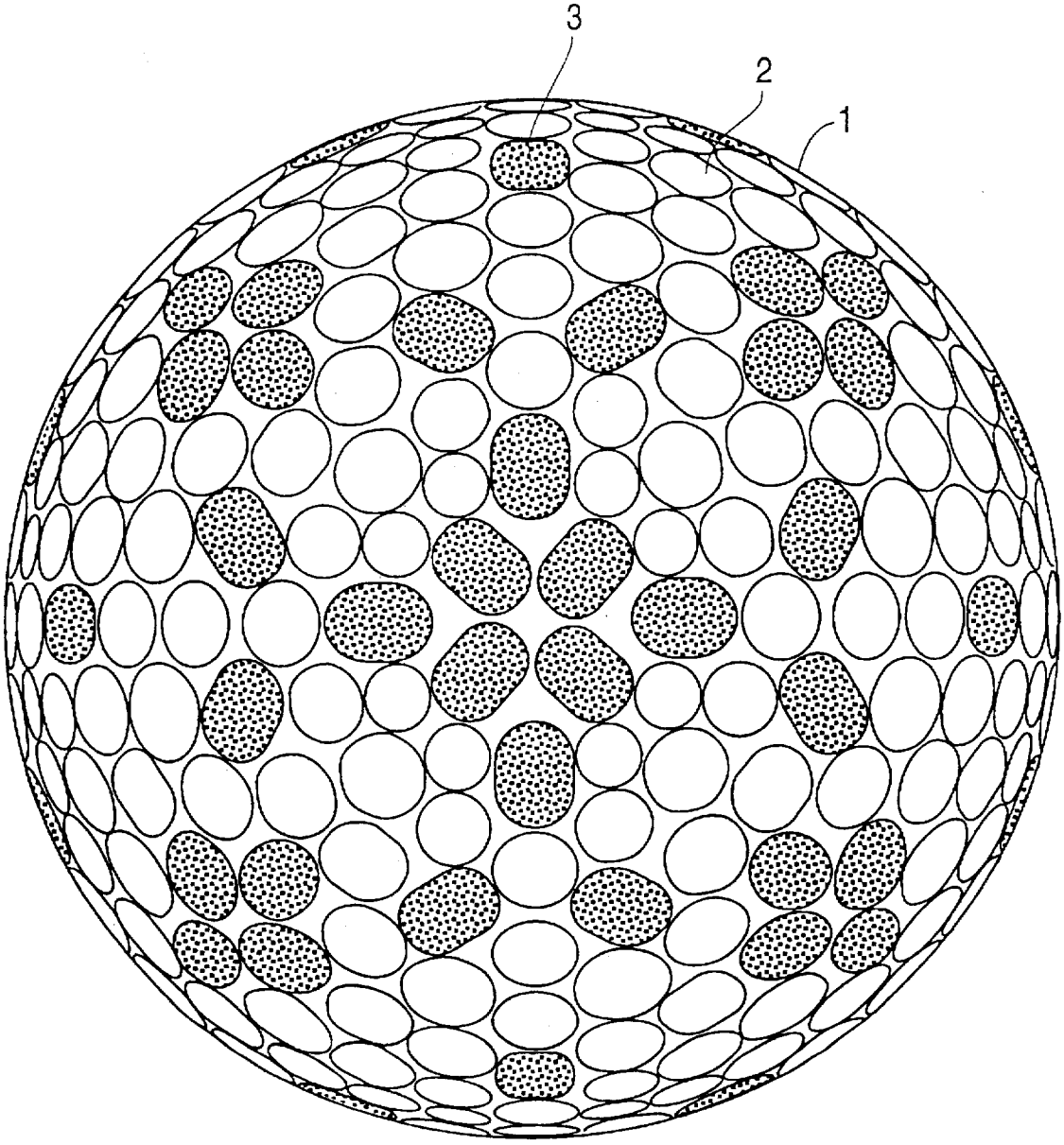
FIG. 7 is a front view showing a golf ball according to a second embodiment.
Figure 8:
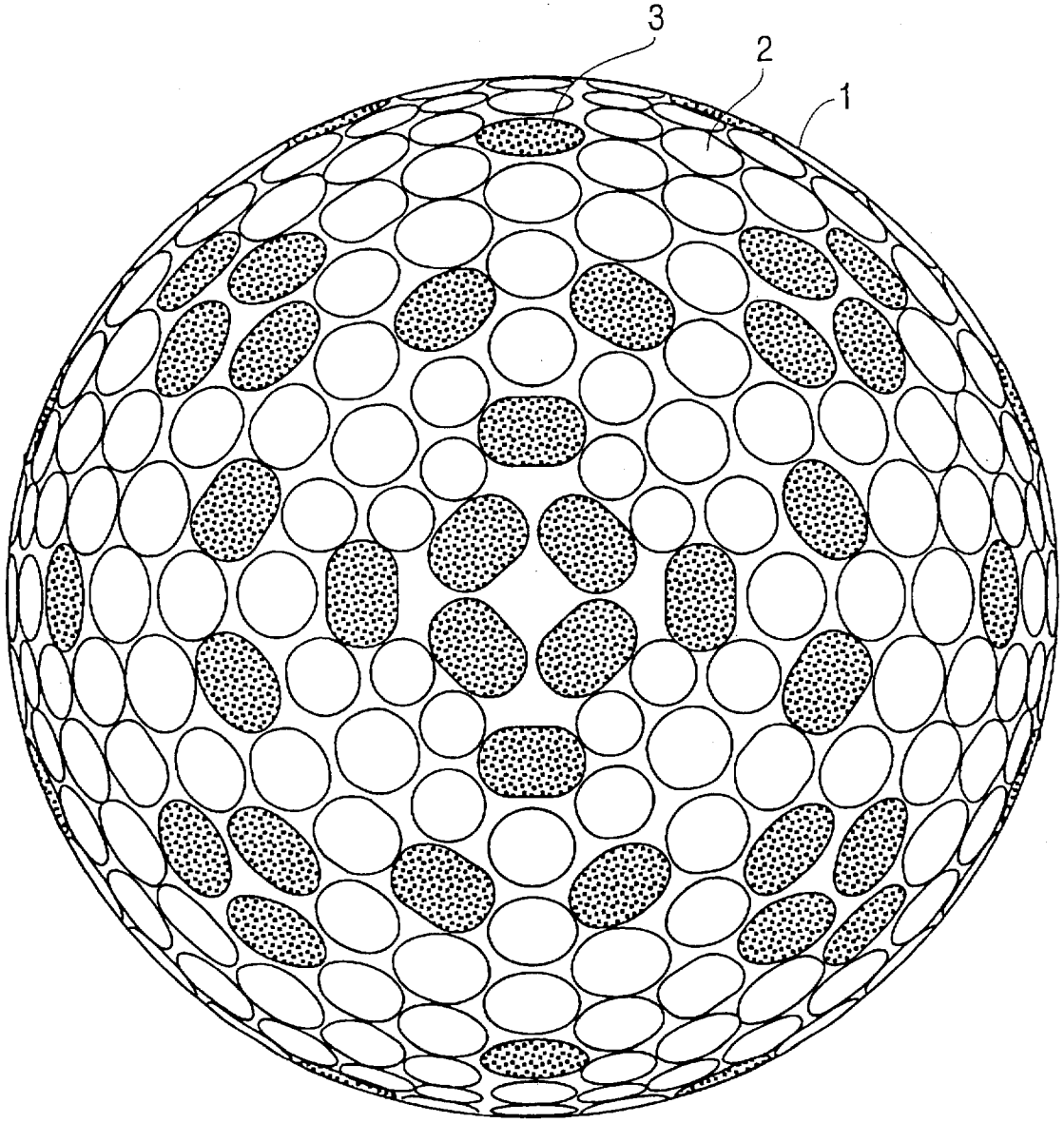
FIG. 8 is a front view showing a golf ball according to a third embodiment.
Figure 9:
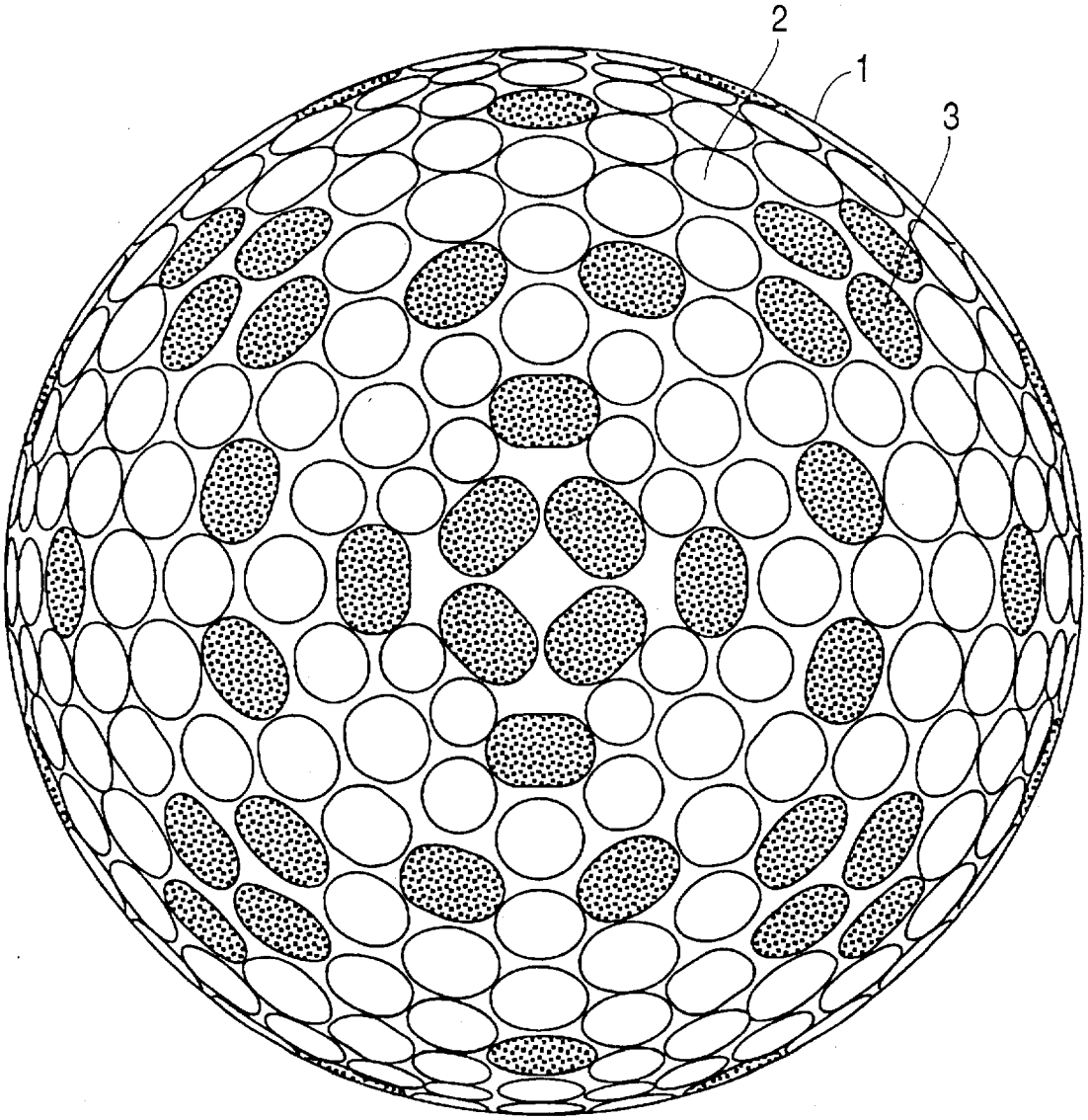
FIG. 9 is a front view showing a golf ball of a first comparison example.
Figure 10:
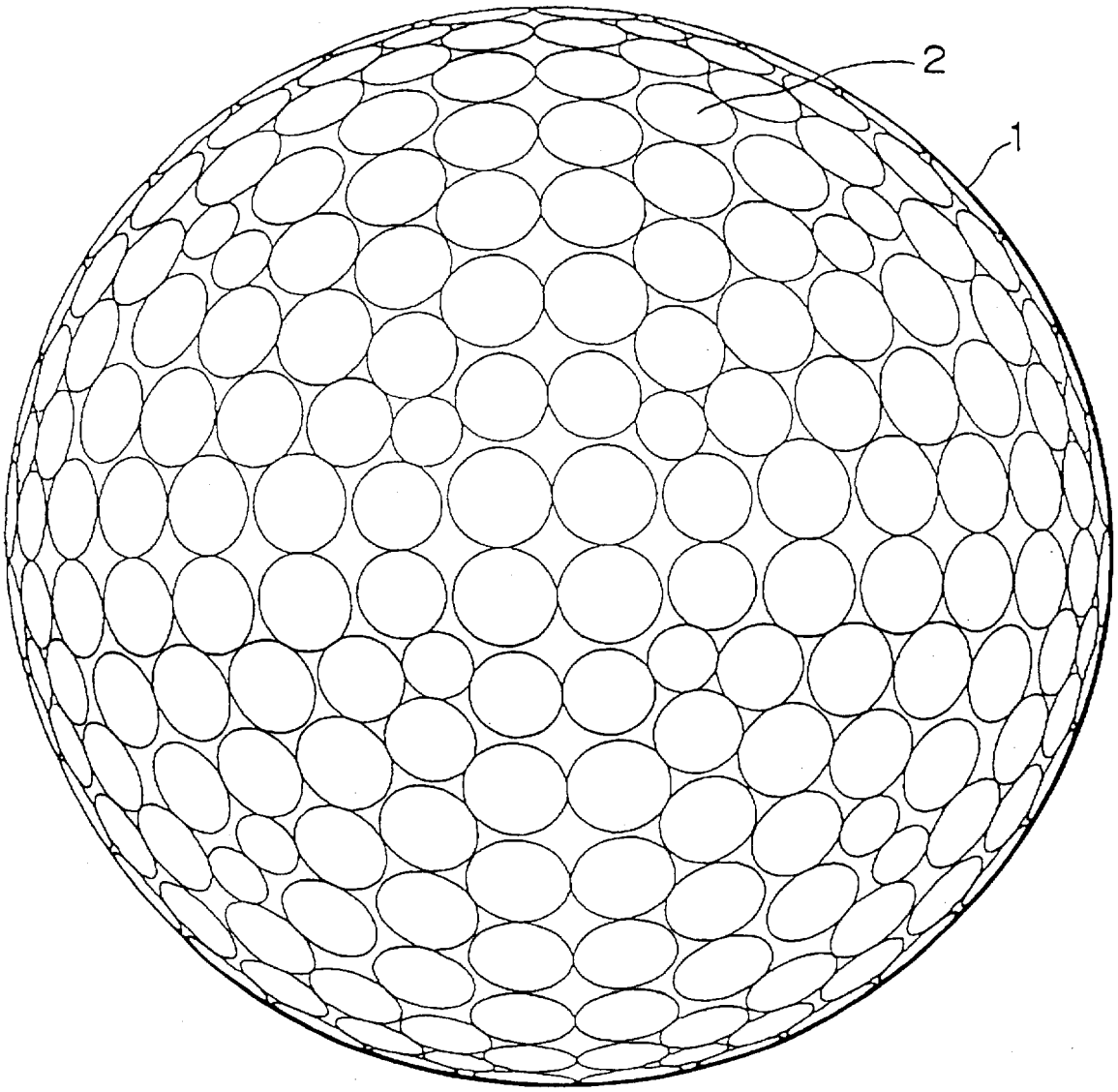
Fig. 10 Prior Art
FIG. 10 is a front view showing a golf ball of a second comparison example.

Table 1 shows the dimple specification of golf balls of first through third embodiments of the present invention and that of golf balls of first and second comparison examples. FIGS. 6 through 8 show the golf balls of the first through third embodiments. FIGS. 9 and 10 show the golf balls of the first and second comparison examples. In FIGS. 6 through 10, a pole is positioned at the center of each golf ball, and a circumference 1 of each golf ball indicates the seam line. White dimples shown in FIGS. 6 through 10 are circular dimples 2, and black dimples shown in FIGS. 6 through 10 are oval dimples 3 in a narrow sense. As shown in Table 1, the total of dimples (total of all circular dimples 2 and all oval dimples 3) formed on each golf ball is 400.

TABLE 1

| | | | | (4) | (6) | | | | | | |
|---|---|---|---|---|---|---|---|---|---|---|---|
| | (1) | (2) | (3) | (5) | D1 | D2 | L | (7) | (8) | (9) | (10) |
| | A, | 88 | | | 4.1 | | | | | | |
| Emb. 1 | B | 40 | 400 | 3.7 | | | | | | | |
| | C | 40 | | 3.2 | | | | 560 $mm^3$ | 50% | 28.3 | |
| | D | 32 | | 2.8 | | | | | | | |

TABLE 1-continued

| | (1) | (2) | (3) | (4) (5) | (6) D1 | D2 | L | (7) | (8) | (9) | (10) |
|---|---|---|---|---|---|---|---|---|---|---|---|
| FIG. 6 | E | 80 | | — | 3.2 | 3.2 | 1.3 | | | | 1.41 |
| | F | 120 | | — | 2.8 | 2.8 | 1.7 | | | | 1.61 |
| | A | 72 | | 4.1 | | | | | | | |
| Emb. 2 | B | 160 | 400 | 3.7 | | | | | | | |
| | C | 48 | | 3.2 | | | | 560 | 22% | 28.0 | |
| | D | 32 | | 2.8 | | | | | | | |
| FIG. 7 | E | 32 | | — | 3.2 | 3.2 | 1.3 | | | | 1.41 |
| | F | 56 | | — | 2.8 | 2.8 | 1.7 | | | | 1.61 |
| | A | 80 | | 4.1 | | | | | | | |
| Emb. 3 | B | 152 | 400 | 3.7 | | | | | | | |
| | C | 48 | | 3.2 | | | | 560 | 22% | 79.4 | |
| | D | 32 | | 2.8 | | | | | | | |
| FIG. 8 | E | 32 | | — | 3.2 | 3.2 | 1.3 | | | | 1.41 |
| | F | 56 | | — | 2.8 | 2.8 | 1.7 | | | | 1.61 |
| | A | 80 | | 4.1 | | | | | | | |
| Com. 1 | B | 152 | 400 | 3.7 | | | | | | | |
| | C | 48 | | 3.2 | | | | 560 | 22% | 90.0 | |
| | D | 32 | | 2.8 | | | | | | | |
| FIG. 9 | E | 32 | | — | 3.2 | 3.2 | 1.3 | | | | 1.41 |
| | F | 56 | | — | 2.8 | 2.8 | 1.7 | | | | 1.61 |
| | A | 200 | | 4.05 | | | | | | | |
| Com. 2 | B | 64 | 400 | 3.90 | | | | | | | |
| | C | 96 | | 3.60 | | | | 560 | 0% | — | |
| | D | 40 | | 2.80 | | | | | | | |
| FIG. 10 | E | — | | — | — | — | — | | | | |
| | F | — | | — | — | — | — | | | | |

(1) denote kind of dimple
(2) denote number of dimples
(3) denote total of dimples
(4) denote circular dimple
(5) denote diameter
(6) denote specificaton
(7) denote total volume of dimple
(8) denote (2)/(3) × 100
(9) denote average δ angle of oval dimple
(10) denote major axis/minor axis In the Table 1, Emb 1, Emb 2, and Emb 3 denote first embodiment, second embodiment, and third embodiment, respectively; and Com.1 and Com.2 denote first comparison example and second comparison example, respectively.

In Table 1, the diameter of each circular dimple 2 is the distance between both points A and B of contact between a common tangent to a golf ball at left and right edges thereof.

Figure 1A:
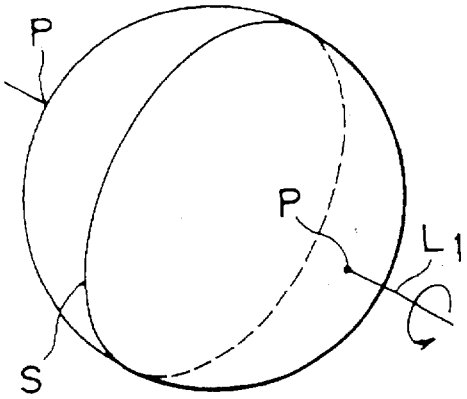
FIGS. 1(A) and 1(B) are schematic views for describing seam hitting and pole hitting of a golf ball.
Figure 1B:
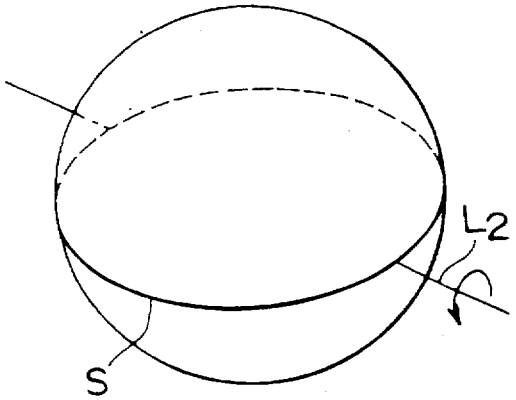
Figure 3:
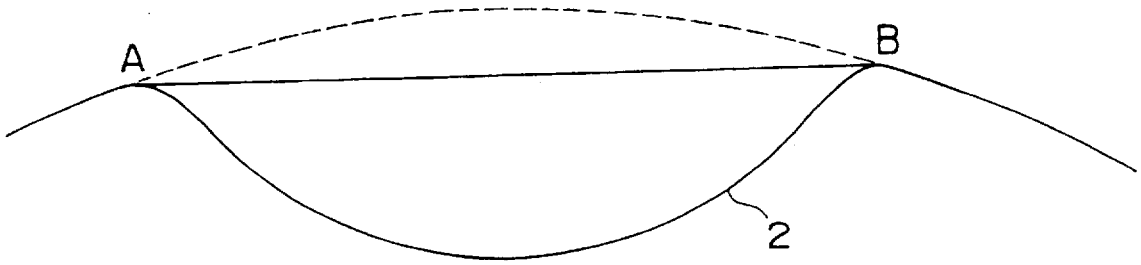
FIG. 3 is a view for describing the diameter of a circular dimple.
Figure 2:
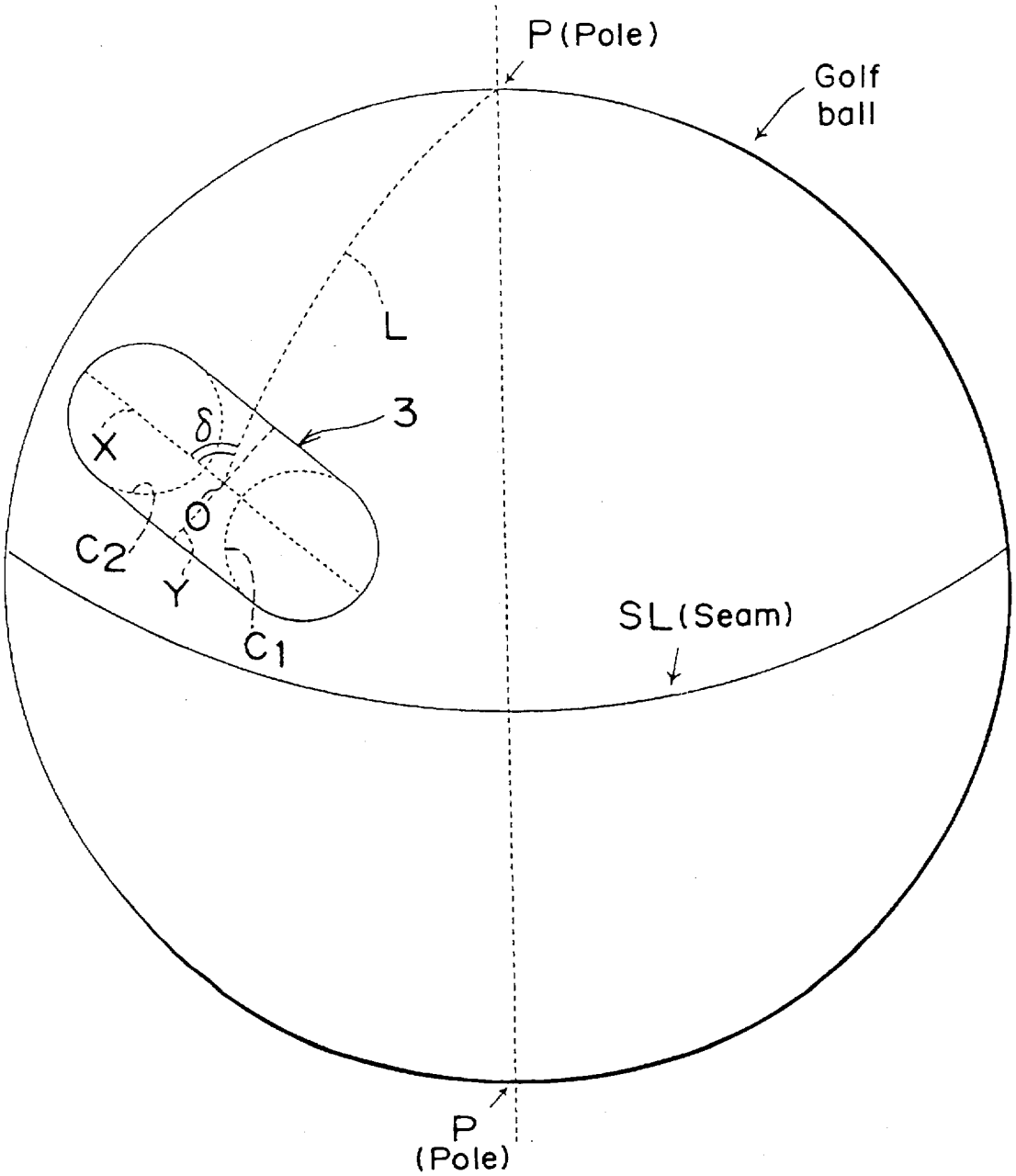
FIG. 2 is a view for describing an oval dimple to be adopted as a dimple of a golf ball according to the present invention.
Figure 4:
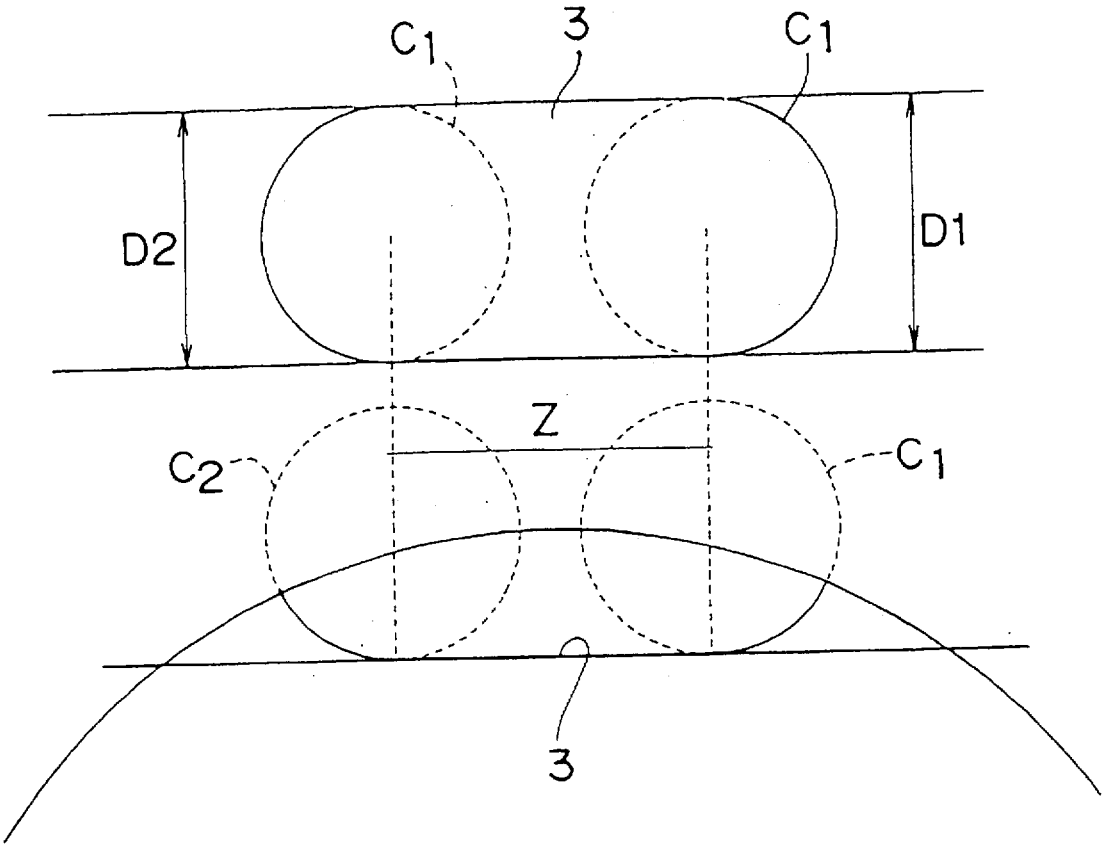
FIG. 4 is a view for describing the oval dimple.

As shown in FIGS. 2 and 4, the oval dimple 3 is formed by connecting two circles $C_1$ and $C_2$ spaced at a certain interval with two common tangents. Reference symbols D1 and D2 in Table 1 denote the diameter of each of the circles $C_1$ and $C_2$. Reference symbol Z in FIG. 4 denotes the length of each of the common tangents to the circles $C_1$ and $C_2$.

Figure 5:
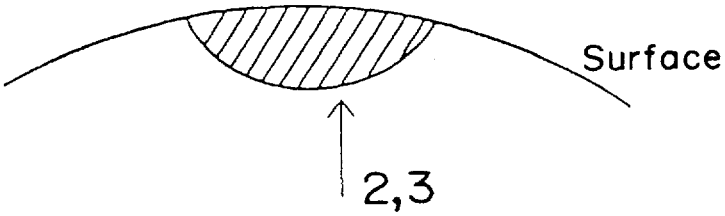
FIG. 5 is a view for describing the volume of a dimple.

Referring to FIG. 5, the volume of the circular dimple 2 and that of the oval dimple 3 are the volume of a portion, shown with oblique lines, surrounded with an imaginary spherical line of the golf ball and the surface of each dimple. The total dimple volume shown in Table 1 is the total of the volumes of all dimples formed on the golf ball. The total volume of dimples to be formed on the golf balls of the embodiments and those of the comparison examples is set to 560 $mm^3$.

An average angle δ of the oval dimple shown in Table 1 is the average of intersection angles made between a major axis (X) of each oval dimple of FIG. 2 and a line (L) connecting the center (O) thereof and a pole (P) of the golf ball with each other. Table 1 also shows the ratio of the length of the major axis (X) to the length of the minor axis (Y) intersecting therewith at a right angle at the center (O) of the oval dimple 2.

As shown in FIG. 6, the golf ball of the first embodiment has the circular dimples 2 and the oval dimples 3 formed on the surface thereof. One great circle path not intersecting with the circular dimples 2 and the oval dimples 3 is formed on the seam line shown by the circumference 1. The total of the oval dimples 3 is 200 which is set to 50% of the total of the dimples formed on the golf ball. The dimples are arranged in such a manner that the average angle δ of the oval dimples 3 is 28.3°. The ratio of the length of the major axis (X) to the length of the minor axis (Y) is set to 1.2 to 3.5. More specifically, the above ratio is set to 1.41 in the case of a dimple (E) and 1.61 in the case of a dimple (F).

As shown in FIG. 7, the golf ball of the second embodiment has the circular dimples 2 and the oval dimples 3 formed on the surface thereof. One great circle path not intersecting with the circular dimples 2 and the oval dimples 3 is formed on the seam line shown by the circumference 1. The total of the oval dimples 3 is 88 which is 22% of the total of the dimples formed on the golf ball. The dimples are arranged in such a manner that the average angle δ of the oval dimple 3 is 28°. Similarly to the first embodiment, the ratio of the length of the major axis (X) to the length of the minor axis (Y) is set to 1.41 in the case of the dimple (E) and 1.61 in the case of the dimple (F).

As shown in FIG. 8, the golf ball of the third embodiment has the circular dimples 2 and the oval dimples 3 formed on the surface thereof. One great circle path not intersecting with the circular dimples 2 and the oval dimples 3 is formed on the seam line shown by the circumference 1. Similarly to the second embodiment, the total of the oval dimples 3 is 88 which is 22% of the total of the dimples formed on the golf ball. The dimples are arranged in such a manner that the average angle δ of the oval dimple 3 is 79.4° The ratio of the length of the major axis (X) to the length of the minor axis (Y) is set to 1.41 in the case of the dimple (E) and 1.61 in the case of the dimple (F), similarly to the first and second embodiments.

As shown in FIG. 9, the golf ball of the first comparison example has the circular dimples 2 and the oval dimples 3 formed on the surface thereof. One great circle path not intersecting with the circular dimples 2 and the oval dimples 3 is formed on the seam line shown by the circumference 1. The total of the oval dimples 3 is 88 which is 22% of the total of the dimples formed on the golf ball, similarly to the second and third embodiments. The dimples are arranged in such a manner that the average angle δ of the oval dimple 3 is 90°. The ratio of the length of the major axis (X) to the length of the minor axis (Y) is set to 1.41 in the case of the dimple (E) and 1.61 in the case of the dimple (F), similarly to the first through third embodiments.

As shown in FIG. 10, the golf ball of the second comparison example has only the circular dimples 2 formed thereon. Including the one present on the seam line 1, the golf ball has three great circle paths, not intersecting with the oval dimples 2, formed on the surface thereof.

Each of the golf balls of the first through third embodiments and the golf balls of first and second comparison examples has a double construction, i.e., each golf ball comprises a core, the inner diameter of which is about 38.4 mm and a cover. That is, the golf ball is a two-piece ball. The outer diameter of the golf ball is 42.75±0.05 mm and the compression thereof is 95±3.

In manufacturing the two-piece golf ball, materials are mixed with each other according to a mixing ratio shown in Table 2, and a mixture is kneaded by using an internal mixer to form a cylindrical plug. The plug is put into a pressurizing/heating molding die to vulcanize it at 150° C. for 40 minutes to form a core having a diameter of 38.4 mm. The mixture of Surlyn 1707 (manufactured by Mitsui Dupon Polychemical Product Corp.) and titanium oxide mixed at a ratio of 100:2 is molded by injection, with the core covered with the mixture to form a golf ball having an outer diameter of 42.75 mm. Then, burr formed on the seam line is removed from the golf ball, and the surface thereof is painted.

TABLE 2

| Material | Parts by weight |
|---|---|
| Polybutadiene | 100 |
| Zinc acrylate | 34 |
| Zinc oxide | 17 |
| Dicumyl peroxide oxide | 1.0 |

Comparison experiments were conducted on golf balls on which dimples were formed based on the specification of the first through third embodiments and that of the first and second comparison examples.

The golf balls having the dimple specification shown in Table 1 were hit by a driver (W#1) at a head speed 48.9 m/s by using a swing robot manufactured by True Temper Corp. Wind was fair and almost windless, namely, 0.1–0.3 m/s. 48 golf balls were prepared for each of the first through third embodiments and the first and second comparison examples. 24 golf balls were hit by pole hitting and seam hitting, respectively.

Carries, flight times, and angles of elevation were measured for each golf ball.

The carry is the distance from a ball-hit position to a ball-drop position. The flight time is a time period from a point when the golf ball is hit to a point when it has dropped on the ground. The angle of elevation is an angle formed between a horizontal line and a line connecting the hit position and the highest point of trajectory with each other.

Table 3 shows results of measurements made in the experiment.

TABLE 3

| | | Carry (yds) | Flight time (sec) | Elevation angle (°) |
|---|---|---|---|---|
| Emb 1 | Pole hitting | 252.5 | 7.08 | 12.75 |
| | Seam hitting | 252.3 | 7.04 | 12.73 |
| | Remainder (Pole-Seam) | 0.2 | 0.04 | 0.02 |
| Emb 2 | Pole hitting | 251.4 | 7.03 | 12.69 |
| | Seam hitting | 250.7 | 6.96 | 12.63 |
| | Remainder (Pole-Seam) | 0.7 | 0.07 | 0.06 |
| Emb 3 | Pole hitting | 250.8 | 6.98 | 12.66 |
| | Seam Hitting | 249.3 | 6.91 | 12.53 |
| | Remainder (Pole-Seam) | 1.5 | 0.09 | 0.13 |
| Com. 1 | Pole hitting | 249.1 | 6.91 | 12.60 |
| | Seam hitting | 246.6 | 6.75 | 12.27 |
| | Remainder (Pole-Seam) | 2.5 | 0.16 | 0.33 |
| Com. 2 | Pole hitting | 247.8 | 6.82 | 12.46 |
| | Seam hitting | 245.7 | 6.70 | 12.21 |
| | Remainder (Pole-Seam) | 2.1 | 0.12 | 0.25 |

In the Table 3, Emb 1, Emb 2, and Emb 3 denote first embodiment, second embodiment, and third embodiment, respectively; and Com.1 and Com.2 denote first comparison example and second comparison example, respectively.

As shown in Table 3, the experimental results indicate the following points:

As described previously, the golf balls of the first embodiment have the following dimple specification: The total of the oval dimples 3 is set to 50% of the total of the dimples formed on the golf ball. The average angle δ of the oval dimple 3 is 28.3°. The ratio of the length of the major axis (X) to the length of the minor axis (Y) is set to 1.41 and 1.61 which are in the preferable range from 1.2 to 3.5.In the golf balls, the average of the angles of elevation in trajectory measured in pole hitting and seam hitting was 12.74° which was highest of all the averages of the angles of elevation of the five kinds of golf balls; and the average of the carries measured in pole hitting and seam hitting was 252.5 yards which was longest of all the averages of the carries of the five kinds of golf balls. The symmetrical property of the golf balls was superior: The difference in the carry, the flight time, and the angle of elevation between pole hitting and seam hitting were 0.2 yards, 0.04 seconds, and 0.02°, respectively.

As described previously, the golf balls of the second embodiment have the following dimple specification: The total of the oval dimples 3 is set to 22% of the total of the dimples formed on the golf ball. The average angle δ of the oval dimple 3 is 28.0°. The ratio of the length of the major axis (X) to the length of the minor axis (Y) is set to 1.41 and 1.61 which is in the preferable range from 1.2 to 3.5. In the golf balls, the average of the angles of elevation in trajectory measured in pole hitting and seam hitting was 12.66°; and the average of the carries was 251.1 yards which was comparatively long. The symmetrical property of the golf balls was also superior: The difference in the carry, the flight time, and the angle of elevation between pole hitting and seam hitting was 0.7 yards; 0.07 seconds; and 0.06°, respectively.

As described previously, the golf balls of the third embodiment have the following dimple specification: The total of the oval dimples 3 is set to 22% of the total of the dimples formed on the golf ball. The average angle δ of the oval dimple 3 is 79.4°. The ratio of the length of the major axis (X) to the length of the minor axis (Y) is set to 1.41 and 1.61 which is in the preferable range from 1.2 to 3.5. In the golf balls, the average of the angles of elevation in trajectory was 12.60°; and the average of the carries was 250.1 yards which was the third longest of the five kinds of the golf balls. The symmetrical property of the golf balls was also preferable: The difference in the carry, the flight time, and the angle of elevation between pole hitting and seam hitting was 1.5 yards; 0.09 seconds; and 0.13°, respectively.

As described previously, the golf balls of the first comparison example have the following dimple specification: The total of the oval dimples 3 is set to 22% of the total of the dimples formed on the golf ball. The ratio of the length of the major axis (X) to the length of the minor axis (Y) is set to 1.41 and 1.61 which is in the range from 1.2 to 3.5 which is in the range of the present invention. The average angle δ of the oval dimple 3 is 90° which is out of the range of the present invention. In the golf balls, the average of the angles of elevation in trajectory was 12.44° ; and the average of the carries was 248.3 yards which was fairly long, however, the symmetrical property thereof was worst of the five kinds of the golf balls: The difference in the carry, the flight time, and the angle of elevation between pole hitting and seam hitting was 2.5 yards; 0.16 seconds; and 0.33°, respectively.

In the golf balls of the second comparison example having only the circular dimples 2, the average of the angles of elevation in trajectory was 12.34°; and the average of the carries was 246.8 yards. That is, the average of the angles of elevation in trajectory and the average of the carries were smaller than those of the golf ball of the first comparison example. The symmetrical property of the golf balls of the second comparison example was better than that of the first comparison example, but was less favorable than that of the first through third embodiments: The difference in the carry, the flight time, and the angle of elevation between pole hitting and seam hitting was 2.1 yards; 0.12 seconds; and 0.25°, respectively.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball having a large number of dimples formed on the surface thereof, wherein the dimples comprise circular dimples and oval dimples in plan view; the total of the oval dimples is set to more than 20% of the total of the dimples; and the dimples are arranged in such a manner that an average intersection acute angle δ made between a line connecting the center of each oval dimple and a pole of the golf ball with each other and a major axis of each oval dimple is set in a range of $0 \leqq \delta \leqq 80°$.

2. The golf ball according to claim 1, wherein each oval dimple has a major axis passing through the center therof and a minor axis passing through the center thereof; and includes an elliptical dimple and an oval dimple, in a narrow sense, formed by connecting two circles with two common tangents; the ratio of a length of the major axis to the length of the minor axis is set in a range of 1.2 to 3.5.

3. The golf ball according to claim 2, wherein the oval dimples consists of the oval dimples in a narrow sense, the elliptical dimples or a combination of the oval dimples in a narrow sense and the elliptical dimples.

4. The golf ball according to claim 3 having only one great circle path, unintersecting with the dimples, formed on the surface thereof.

5. The golf ball according to claim 2 having only one great circle path, unintersecting with the dimples, formed on the surface thereof.

6. The golf ball according to claim 1, wherein the oval dimples consists of oval dimples in a narrow sense, elliptical dimples or a combination of oval dimples in a narrow sense and elliptical dimples.

7. The golf ball according to claim 6 having only one great circle path, unintersecting with the dimples, formed on the surface thereof.

8. The golf ball according to claim 1 having only one great circle path, unintersecting with the dimples, formed on the surface thereof.

* * * * *